US006731058B1

(12) United States Patent
Kincade

(10) Patent No.: US 6,731,058 B1
(45) Date of Patent: May 4, 2004

(54) ARC PATH FORMED IN LAMP BODY

(75) Inventor: Randal S. Kincade, Irvine, CA (US)

(73) Assignee: Ushio America, Inc., Cypress, CA (US)

( * ) Notice: Subject to any disclaimer, the term of this patent is extended or adjusted under 35 U.S.C. 154(b) by 310 days.

(21) Appl. No.: 09/591,799

(22) Filed: Jun. 12, 2000

(51) Int. Cl.[7] ..... H01J 17/16; H01J 61/30
(52) U.S. Cl. ..... 313/493; 313/634; 313/317
(58) Field of Search ..... 313/493, 484, 313/485, 488, 635, 636, 573, 574, 317; 362/260

(56) References Cited

U.S. PATENT DOCUMENTS

| | | | | | |
|---|---|---|---|---|---|
| 3,508,103 | A | * | 4/1970 | Young | 313/493 |
| 4,920,298 | A | * | 4/1990 | Hinotani et al. | 313/493 |
| 5,319,282 | A | * | 6/1994 | Winsor | 315/169.4 |
| 5,466,990 | A | * | 11/1995 | Winsor | 315/56 |
| 5,767,618 | A | * | 6/1998 | Maya et al. | 313/493 |
| 5,834,888 | A | * | 11/1998 | Allen et al. | 313/484 |
| 5,850,122 | A | * | 12/1998 | Winsor | 313/493 |
| 5,907,222 | A | * | 5/1999 | Lengyel et al. | 315/158 |
| 6,011,354 | A | * | 1/2000 | Tsai et al. | 313/634 |
| 6,100,635 | A | * | 8/2000 | Winsor | 313/493 |
| 6,114,809 | A | * | 9/2000 | Winsor | 315/50 |
| 6,130,436 | A | * | 10/2000 | Renau et al. | 250/492.21 |
| 6,559,599 | B1 | * | 5/2003 | Cooch et al. | 313/634 |
| 2002/0105259 | A1 | * | 8/2002 | Kim | 313/491 |

* cited by examiner

*Primary Examiner*—Ashok Patel
*Assistant Examiner*—Karabi Guharay

(74) *Attorney, Agent, or Firm*—J.D. Harriman II, Esq.; Coudert Brothers LLP

(57) ABSTRACT

The present invention provides an arc path formed in a lamp body. In accordance with one or more embodiments of the present invention, the lamp body has a plurality of closely spaced, parallel vanes which form an arc path. In one embodiment, the lamp body comprises a bottom and top plate, and a front and back sealing member. The bottom plate may be a flat plate which can be made of quartz or other suitable material. The plate has a plurality of vanes machined into it out to its edges. Alternatively, the vanes may be separate and sealed onto the bottom plate. The top plate is sealed to the bottom plate. The front and back sealing members are sealed to the plates to complete the seal of the lamp body. In another embodiment, the bottom plate is a solid block of quartz or other suitable glass material, which can have the vane pattern machined onto it stopping short of the edges. The solid block is then sealed at the top and outside edges by the top plate, without the need for front and back sealing members. In another embodiment, a solid block of quartz or other suitable glass material has holes drilled completely through it. The material left between the holes at the front and back ends forms a septum. Every other septum is machined back to provide clearance for the arc as it moves through the arc path and turns the corner at the end of each hole. The front and back ends are then sealed to complete the lamp body. In one embodiment, the top and bottom plates are designed to emit differing wavelengths of light. In another embodiment, the bottom plate is mirrored or has a highly reflective coating, which provides increased output from a single side of the lamp. In yet another embodiment, the lamp emission can be focused on a single point using a plurality of lenses.

6 Claims, 10 Drawing Sheets

ARC PATH FORMED IN LAMP BODY

BACKGROUND OF THE INVENTION

1. Field of the Invention

The present invention relates to lamps, and in particular to an electric discharge lamp with a lamp body having an arc path formed therein.

2. Background Art

An electric discharge lamp is a lighting device comprising a transparent tube within which a gas is energized by an applied voltage and thereby made to glow. A fluorescent lamp is an electric discharge lamp that produces light by the fluorescence of a phosphor coating. A fluorescent lamp comprises a glass tube filled with a mixture of argon and mercury vapour. The glass tube in a fluorescent lamp can be straight or it can comprise a grid having a plurality of "U" shaped turns forming a serpentine pattern.

Metal electrodes at each end of the glass tube are coated with an alkaline-earth oxide that gives off electrons easily. When current flows through the ionized gas between the electrodes, it emits ultraviolet radiation. The inside of the tube is coated with phosphors, which are substances that absorb ultraviolet radiation and fluoresce (re-radiate the energy as visible light). Two common phosphors are zinc silicate and magnesium tungstate. A starter and ballast provide the extra voltage, up to four times of the operating voltage, needed to ionize the gas when starting.

Conventional Electric Discharge Lamps

The glass tubes in some prior art electric discharge lamps are quartz tubes which, as stated above, can be straight or serpentine shaped. An example of a serpentine shaped electric discharge lamp is shown in FIGS. 1A and 1B. In the flat type fluorescent lamp lighting device shown in FIG. 1B, the numerals 21 and 22 represent two transparent glass plates assembled and sealed by solder glass at the periphery thereof to form a lamp body. The transparent glass plate 22 has a groove 23 formed by a forming process at its facing surface against the glass plate 21. On the inner surface of the groove 23 is provided with a fluorescent film 24. The groove 23 forms a discharge channel 25 in a serpentine form extending over most of the surface area of the transparent glass plate 21. Discharge channel 25 is sealed and filled with mercury-vapor and an inert gas such as argon.

Both the ends of the discharge channel 25 have electrode leads 26A and 26B, one electrode lead provided at each end. An exhaust pipe 27 extending out from a part of the discharge channel is one whose tip is cut off after the completion of the processes of exhausting the air and filling in the gas. A reflecting layer 28 is formed by a film of metal, metallic oxide or resin which is coated or vapor-deposited on the non-luminous back side surface of the transparent glass plate 22.

A light transmission uniformity means in the form of a mask 29 is also formed by a film of metal, metallic oxide or resin which is coated or vapor-deposited on the luminous side surface of the transparent glass plate 21. The thickness or the area of the mask may partially be varied for the brightness distribution to be uniform at the luminous surface of the transparent glass plate 21. The reflecting layer 28 and the mask 29 are formed directly or integrally on the transparent glass plates 22 and 21, respectively, but it can be arranged that, instead of the reflecting layer 28 and the mask 29, a defuse plate or a reflecting plate may separately be placed one at the front side of the transparent glass plate 21 and the other at the back side of the transparent glass plate 22. Glass cover or reflector 30 forms a layer above the lamp body.

Difficulties in Forming the Arc Path

The serpentine discharge channel 25, shown in FIG. 1, defines a plurality of arc paths extending lengthwise across the transparent glass plate 21. The larger the number of turns in the serpentine form, the better will be the uniformity in the brightness distribution. Due to the physical limitations associated with current lamps, however, the number of turns that one can manufacture into serpentine discharge channel 25 is limited because the minimum thickness of the wall of the quartz tube used to construct serpentine discharge channel 25 is 1 millimeter. Therefore, at a minimum, 2 millimeters of glass are in between each parallel channel in the arc path of the lamp body.

In addition, structural limitations associated with a channel of bent glass further make the configuration of FIG. 1 disadvantageous. First, when forming a glass channel such as the one shown in FIG. 1, glass is gathered on the inside of the radius of each bend, for instance at locations 40 and 50. FIG. 1C provides an enlarged view of a prior art bend. Inside radius 40 is a thick wall of glass and illustrates where glass has gathered in the manufactured bend. When the glass is gathered at the bends as shown in FIG. 1C, it causes a non-uniformity of thickness in the bends of serpentine discharge channel 25. The non-uniformity of thickness causes the lamp to produce dark spots in these areas separating the arcs. Second, the outside of each bend becomes thin, for instance at locations 60 and 70, which makes the lamp body extremely fragile and prone to breaking. As shown in the expanded view of FIG. 1C, the outside radius 60 of the bend is much thinner than the inside radius 40 of the bend. What is needed is a lamp that has a rigid lamp body with arc paths that are extremely close together so it can provide a more uniform output of light.

SUMMARY OF THE INVENTION

The present invention provides an arc path formed in a lamp body. In accordance with one or more embodiments of the present invention, the lamp body has a plurality of closely spaced, parallel vanes which form the arc path. In one embodiment, the lamp body comprises a bottom and top plate, and a front and back sealing member. The bottom plate may be a flat plate, which may be made of quartz or other suitable glass material, that has a plurality of vanes machined into it out to its edges. Alternatively, the vanes may be separate from the bottom plate and sealed onto it. The top plate is sealed to the bottom plate. The front and back sealing members are sealed to the front and back ends of the plates to complete the seal of the lamp body.

In another embodiment, the bottom plate is a solid block. The block can be made of quartz or other suitable glass material, which has the vane pattern machined onto it stopping short of the edges. The solid block is then sealed at the top and outside edges by the top plate, without the need for front and back sealing members. In another embodiment, a solid block of quartz or other suitable glass material has holes drilled completely through it. The material left between the holes at the front and back ends forms a septum. Every other septum is machined back to provide clearance for the arc as it moves through the arc path and turns the corner at the end of each hole. The front and back ends are then sealed to complete the lamp body.

In one embodiment, the top and bottom plates are designed to emit differing wavelengths of light. This can be accomplished, for instance, by having the top plate be an ozone producing glass and the bottom plate being an ozone free glass. In another embodiment, the bottom plate is mirrored or has a highly reflective coating, which provides increased output from a single side of the lamp. In yet another embodiment, one side of the lamp can be focused on a single point using a plurality of lenses.

The vanes of the present invention allow for a much larger number of turns to be manufactured into the lamp body, which allows for a more even light distribution. Additionally, the vanes provide a structure to the lamp body that is more sturdy than was possible before.

BRIEF DESCRIPTION OF THE DRAWINGS

These and other features, aspects and advantages of the present invention will become better understood with regard to the following description, appended claims and accompanying drawings where:

DETAILED DESCRIPTION OF THE INVENTION

The invention provides an arc path formed in a lamp body. In the following description, numerous specific details are set forth to provide a more thorough description of embodiments of the invention. It is apparent, however, to one skilled in the art, that the invention may be practiced without these specific details. In other instances, well known features have not been described in detail so as not to obscure the invention.

Arc Path Formed in Lamp Body

Some prior art lamp bodies are defined by a tube or groove of bent glass which extends to form an arc path of a serpentine shape. The shape of the arc path is limited in the number of turns that can be manufactured into the lamp body because the thickness of the walls of the glass tube are relatively large. In addition, the structural strength and efficiency of the lamp body is limited because glass is gathered on the inside of the radius of each bend and the outside of each bend becomes thin. This makes the lamp body extremely fragile and prone to breaking and also causes a non-uniformity of light output at the bends where the glass thickness in non-uniform.

To alleviate the disadvantages associated with prior art lamp bodies, the present invention provides an arc path formed within the lamp body. The path is defined by a plurality of vanes which allow for a much larger number of turns to be manufactured into the lamp body. More turns in the lamp body allow for a more even distribution of light output by the lamp. In addition, the vanes provide a structure to the lamp body that is more sturdy than in the prior art. The improved lamp body can be used alone or it can be "tiled" where a plurality of lamp bodies are attached end to end or in another manner which increases the total length of the arc path through the lamp.

Figure 1A:
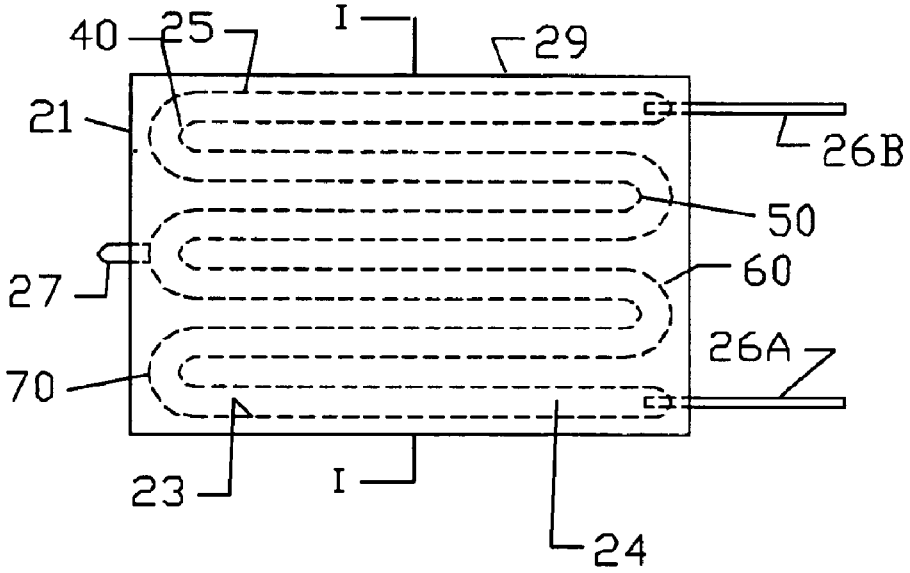
Figure 1A Prior Art
FIG. 1A is a top view of a prior art electric discharge lamp.
Figure 1B:
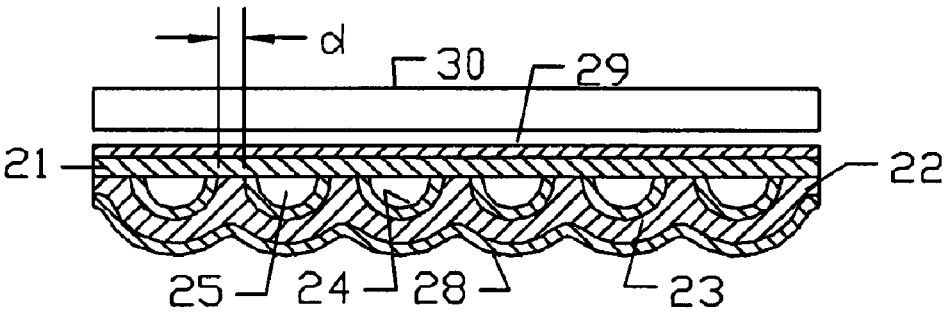
Figure 1B Prior Art
FIG. 1B is a side view of a prior art electric discharge lamp.
Figure 1C:
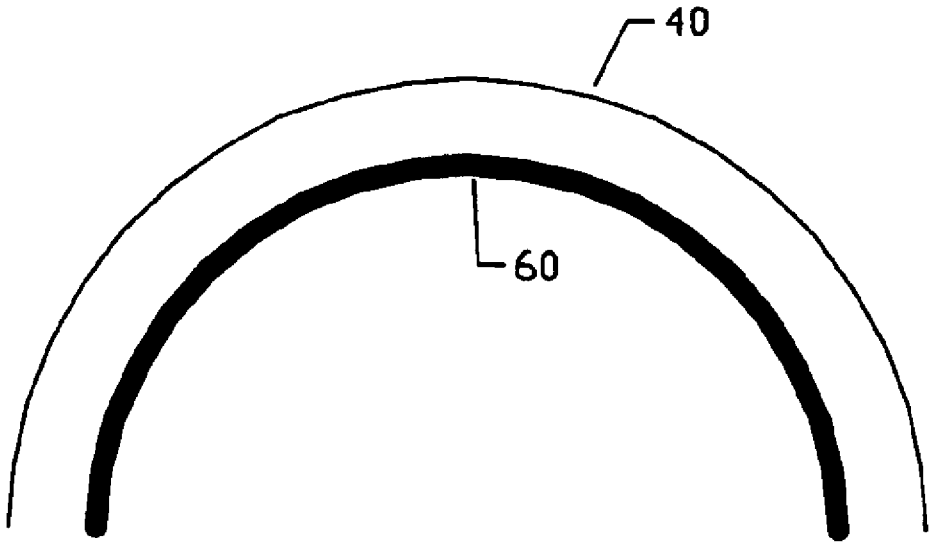
FIG. 1C is a view of the bend of a prior art glass tube.
Figure 2A:
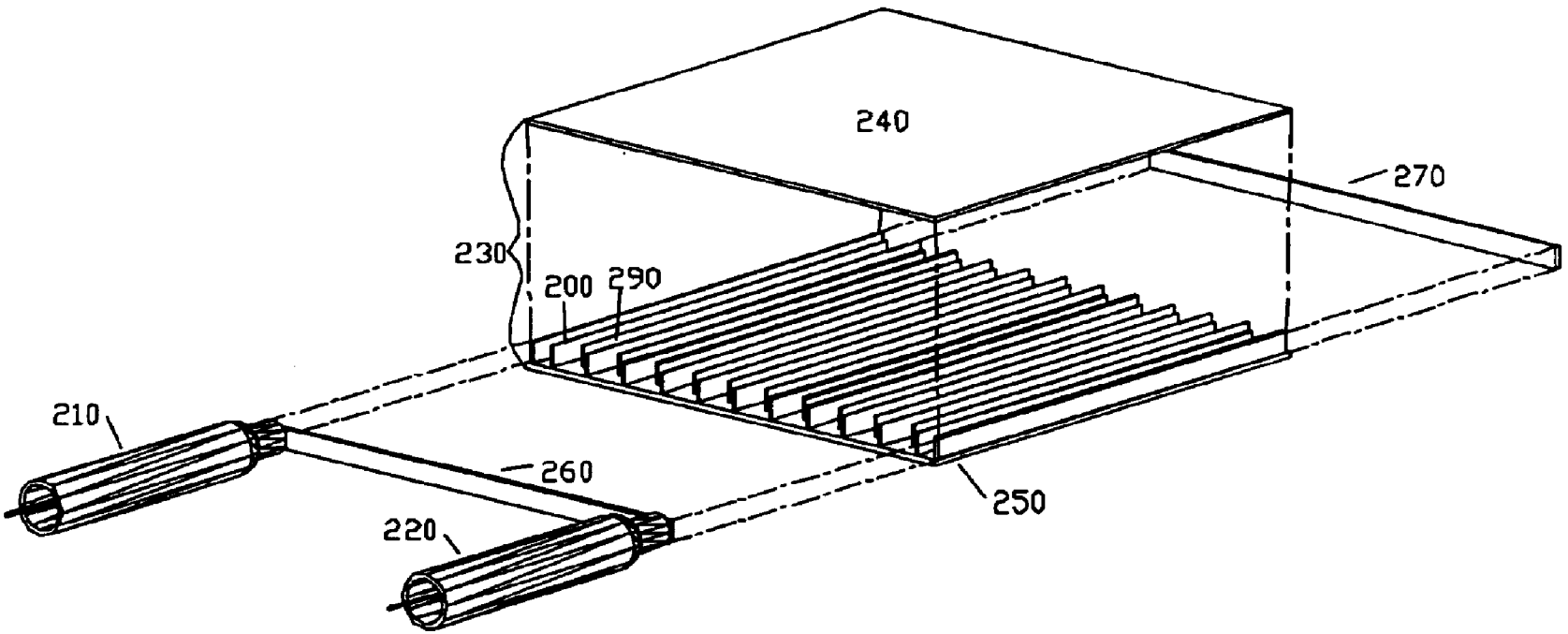
FIG. 2A is an exploded view of a lamp with an arc path formed in the lamp body in accordance with one embodiment of the present invention.

FIG. 2A is an exploded view of a lamp with an arc path formed in the lamp body in accordance with one embodiment of the present invention. The lamp body of FIG. 2A comprises electrodes 210 and 220 attached to lamp body 230. Lamp body 230 comprises top plate 240, bottom plate 250 and sealing members 260 and 270. Bottom plate 250 can be a flat plate made out of quartz or other suitable material. Bottom plate 250 has a plurality of vanes (generally indicated as 280 and 290) attached to it. Vanes 280 and 290 can be attached by sealing them to bottom plate 250 in a conventional manner well known to those skilled in the art. Alternatively, vanes 280 and 290 can be integral to bottom plate 250, by machining vanes 280 and 290 into bottom plate 250. The vanes, 280 and 290, form an arc path through the lamp body.

Top plate 240 is sealed to bottom plate 250. The seal can be accomplished using a glass frit, for instance, in which glass is crushed or ball-milled in order to obtain a fine powder, which is sieved to sizes of 5 to 100 micrometres and then mixed with a small amount of slurry-making organic volatilizing-type vehicles and binders. The slurry is screen-printed onto the object, which is then fired in air or an inert atmosphere in a controlled manner.

Next, sealing members, 260 and 270 are sealed to the front and the back of the lamp body to complete the seal of the arc path in the lamp body. Electrodes 210 and 220 can be of the carbonate coated shell or hot filament type. The electrodes have electrode assemblies which can be sealed to glass plates 240 and 250 using conventional glass sealing techniques well known to those skilled in the art.

Figure 2B:
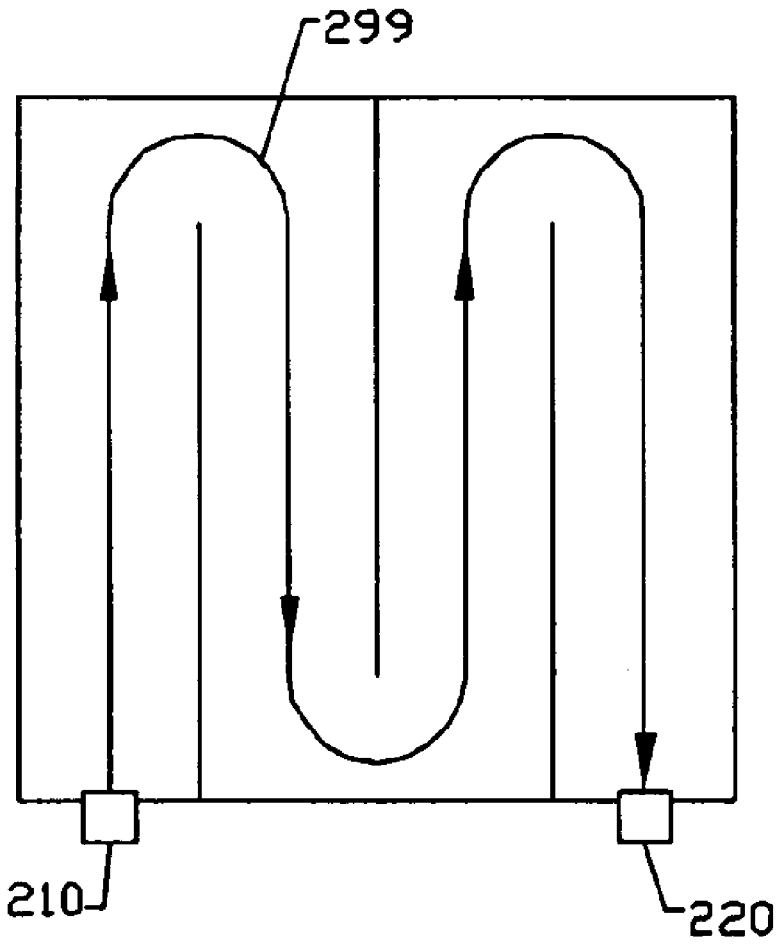
FIG. 2B is an overhead view of a lamp in operation in accordance with one embodiment of the present invention.

The operation of the lamp is described in FIG. 2B. In operation, current flows through ionized gas in the lamp body to form an arc path 299. The arc path 299 begins, for instance, at electrode 210 and moves between the channels formed by the vanes in the lamp body, terminating at electrode 220.

Figure 3:
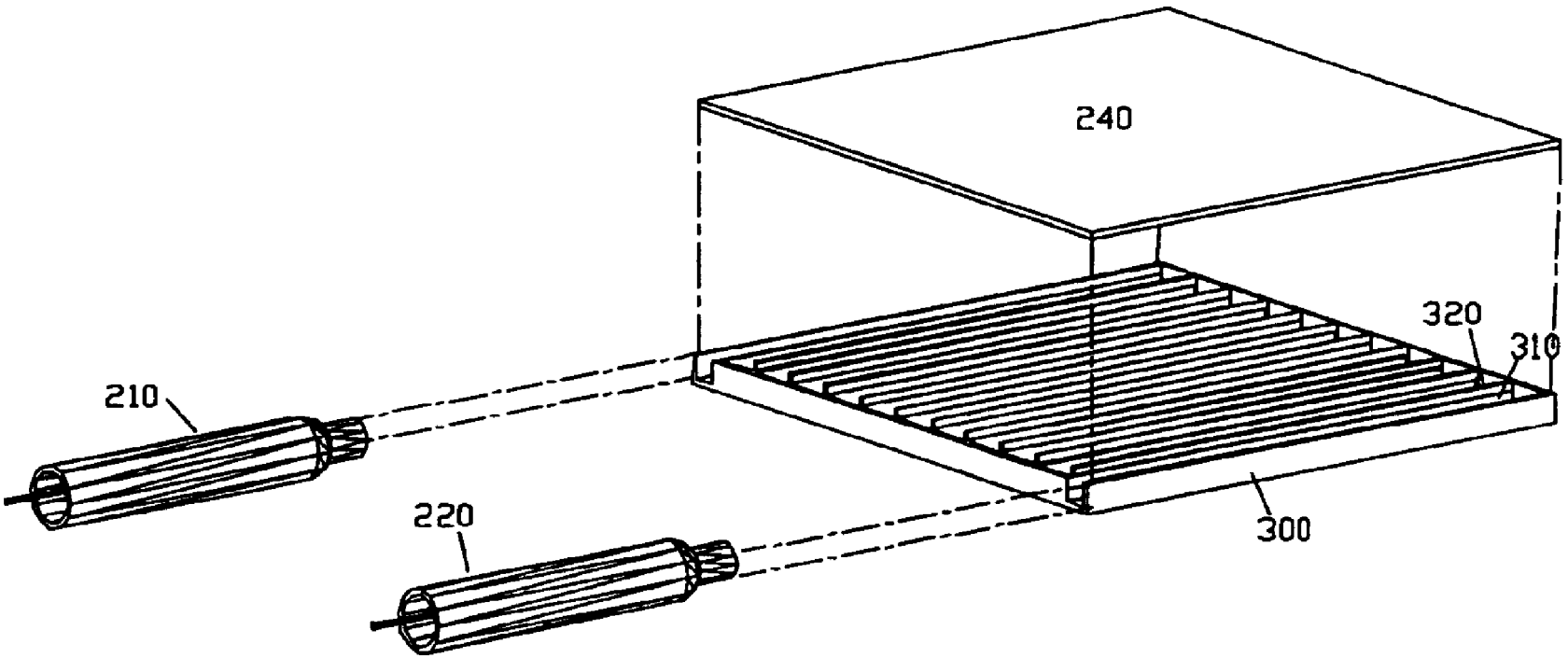
FIG. 3 is an exploded view of a lamp with an arc path formed in the lamp body in accordance with one embodiment of the present invention.

FIG. 3 is an exploded view of a lamp with an arc path formed in the lamp body in accordance with another embodiment of the present invention. In the embodiment of FIG. 3, bottom plate 300 can be a solid block of quartz or other suitable glass material. Vanes (generally indicated as 310 and 320) are machined into bottom plate 300, but unlike vanes 280 and 290 of FIG. 2A, vanes 310 and 320 are not machined all the way out to the front and back edges of the bottom plate. Thus no sealing members are required at the front and back of bottom plate 300, as they are required in FIG. 2. To finally assemble the embodiment of FIG. 3, top plate 240 is sealed to vanes 310 and 320 and to the outside edges of bottom plate 300 in the conventional manner.

Figure 4:
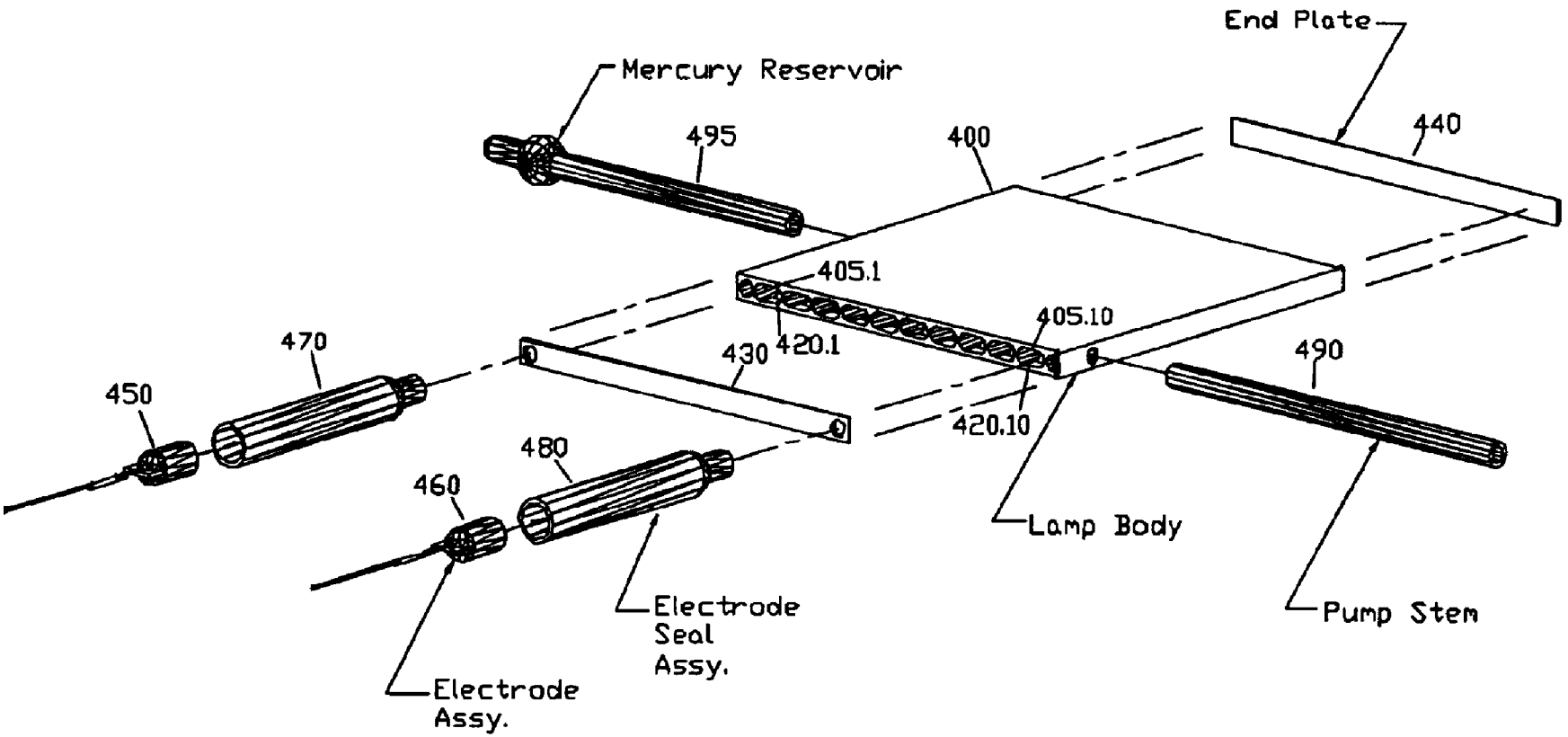
FIG. 4 is an exploded view of a lamp with an arc path formed in the lamp body in accordance with one embodiment of the present invention.

FIG. 4 is an exploded view of a lamp with an arc path formed in the lamp body in accordance with yet another embodiment of the present invention. In the embodiment of FIG. 4, the arc path is integral to lamp body 400, which in this embodiment is a single solid block of quartz or other suitable glass material. The arc path is formed by drilling a plurality of parallel holes 405.1–405.10 completely through lamp body 400. In one embodiment, the parallel holes are spaced 1 millimeter apart, but other spacings are contemplated by the present invention as well. The drilling of the holes can be performed manually or by a computer numerically controlled machine.

The solid material left at the front and back ends between each hole forms a septum 420.1–420.10. Every other septum 420 is machined back to provide axial clearance at the ends of the lamp body for the arc as it moves through the arc path and turns the corner at the end of each hole. Front end plate 430 and back end plate 440 are then sealed over the ends of the lamp body, for instance by providing a flame seal. In a similar manner (i.e., a flame seal), electrode assemblies 450 and 460 housed within electrode seal assemblies 470 and 480 are sealed to the lamp body. Likewise, pump stem 490 housing mercury reservoir 495 is sealed to the lamp body. Pump stem 490 extends to a vacuum system (not shown) so that the lamp body can be backfilled with the gaseous material that makes the lamp operate.

Lamp Body Utilizing Wavelength Differencing

In one embodiment, the lamp body is constructed in such a manner that a first side of the lamp is configured to transmit light at a first wavelength and a second side of the lamp is configured to transmit light at a second wavelength. Thus, the first side of the lamp can be used to transmit lines useable for one purpose, while the second side can transmit lines useable for a second purpose. This can be accomplished, for example by using an ozone producing glass on the first side and an ozone free glass on the second side. In addition to using ozone free and ozone producing glass, the top and bottom plates of the lamp body can be manufactured to have specific wavelength transmission and/or blocking capabilities.

Figure 5:
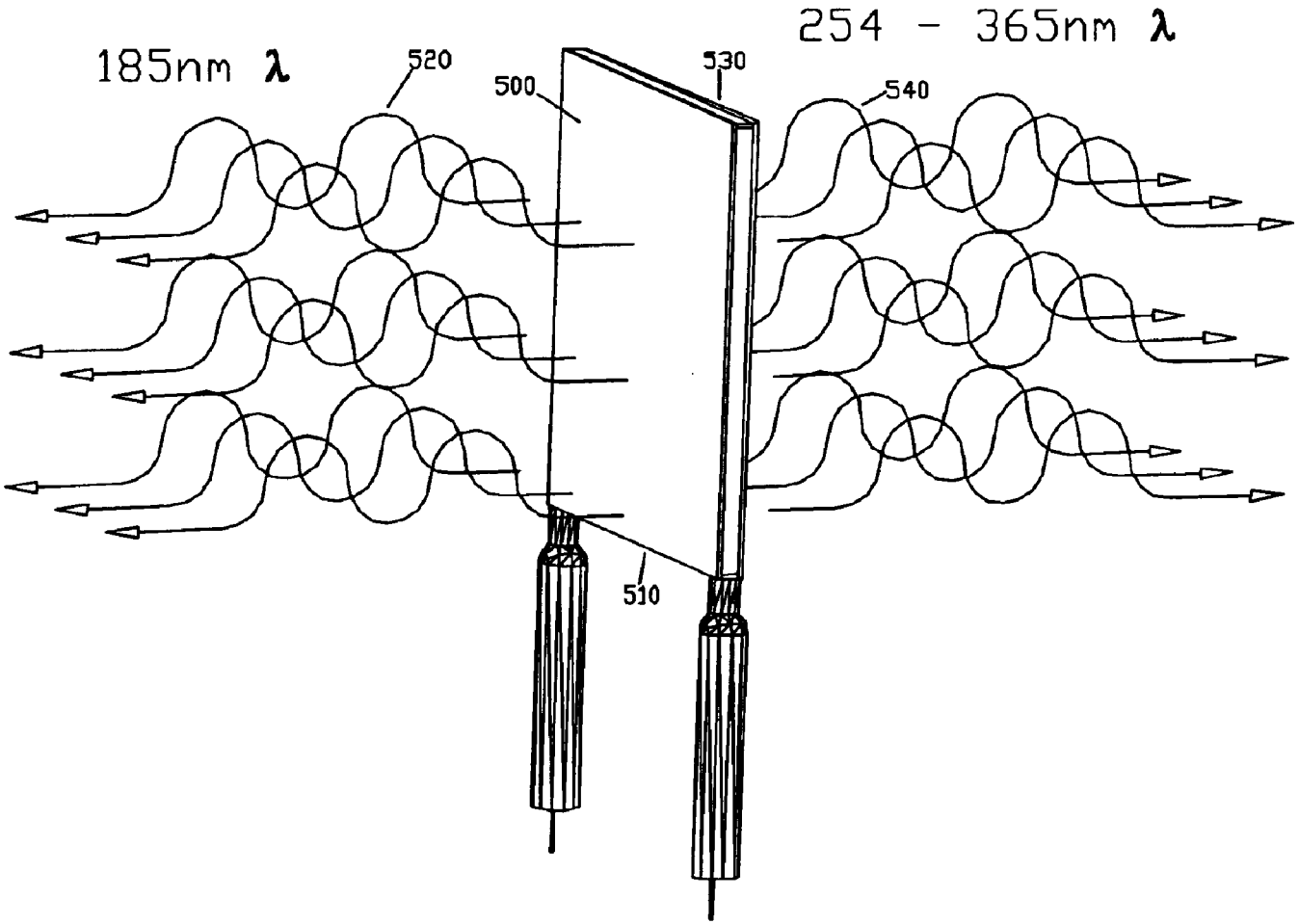
FIG. 5 is a lamp with a lamp body configured to perform wavelength differencing in accordance with one embodiment of the present invention.
Figure 5A:
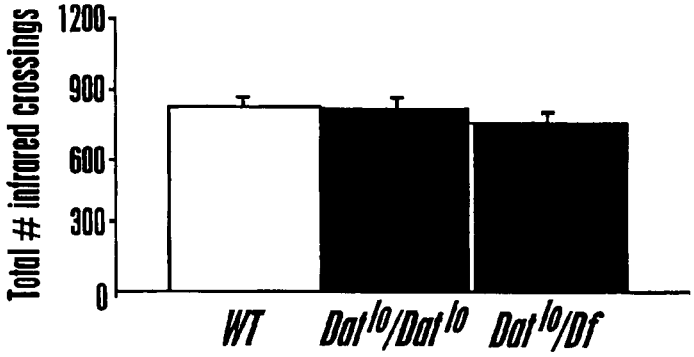
Figure 5B:
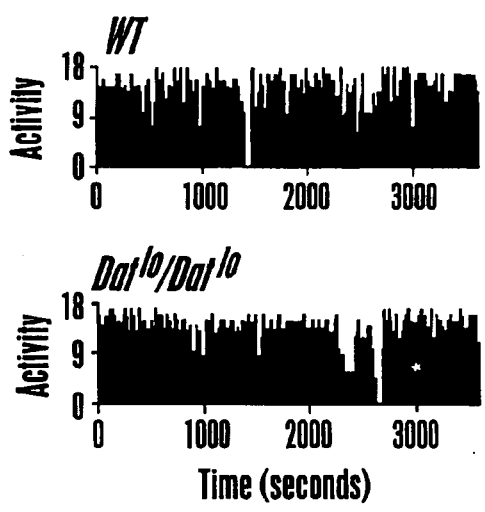
Figure 5C:
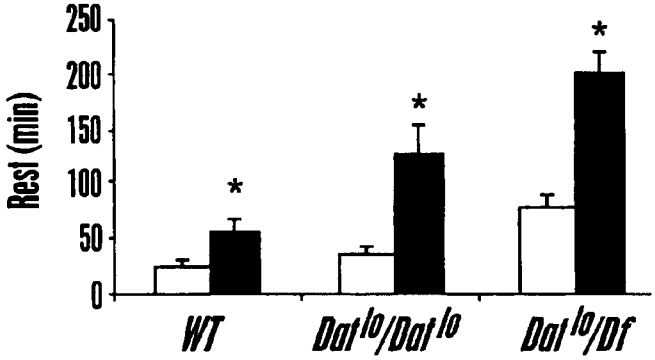
Figure 5D:
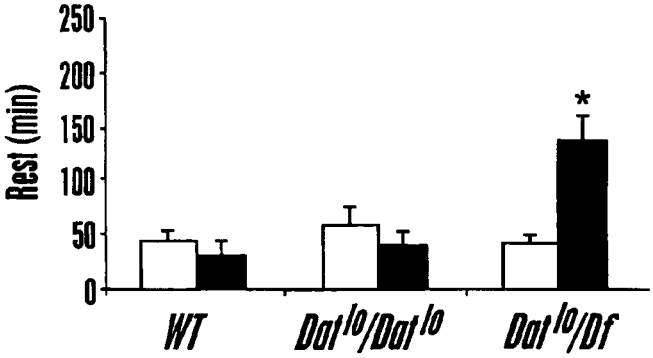

FIG. 5 is a lamp with a lamp body configured to perform wavelength differencing in accordance with one embodiment of the present invention. First side 500 of lamp body 510 is made from a first material. The first material provides the emission of waves 520 at a first wavelength. Second side 530 of lamp body 510 is made from a second material. The second material provides the emission of waves 540 at a second wavelength, where the first waves 520 and the second waves 540 are at differing wavelengths. In this example, the wavelengths emitted are 185 nanometers and a range of 254–365 nanometers respectively, but the exact wavelengths emitted differ in various embodiments.

Lamp Body With a Mirrored Surface

Figure 6:
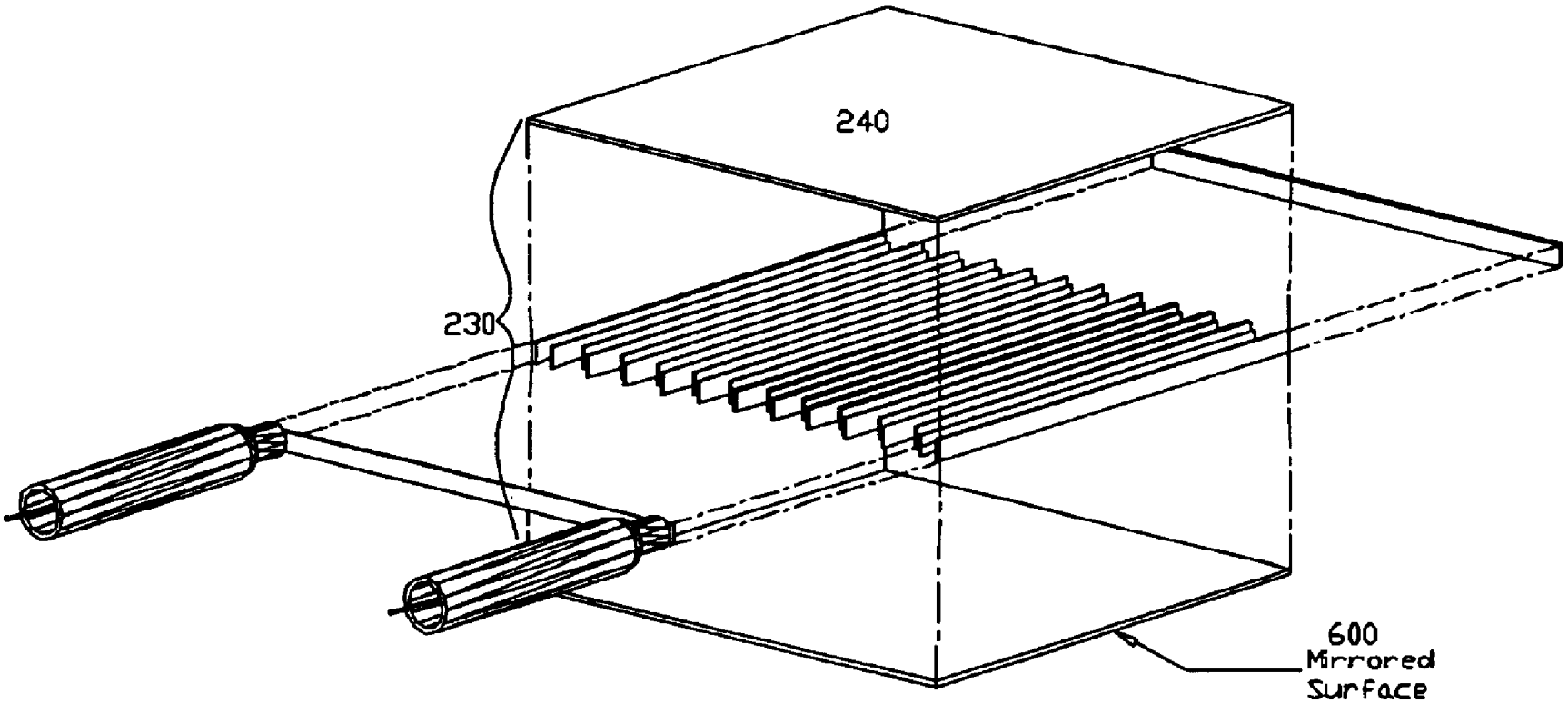
FIG. 6 is a lamp with a lamp body having a mirrored surface in accordance with one embodiment of the present invention.

FIG. 6 is a lamp with a lamp body having a mirrored surface in accordance with one embodiment of the present invention. FIG. 6 shows a configuration similar to the embodiment described in connection with FIG. 2A, but it should be noted that a mirrored surface can be implemented with any configuration of the present invention including those described in FIGS. 3 and 4. FIG. 6 includes a bottom plate 600 which is a mirrored surface. In operation, when the lamp emits light waves, mirrored surface 600 acts to direct the light waves out of top plate 240, which causes an increased output from the top side of lamp body 230.

Lamp Body Having a Lens Array

Figure 7:
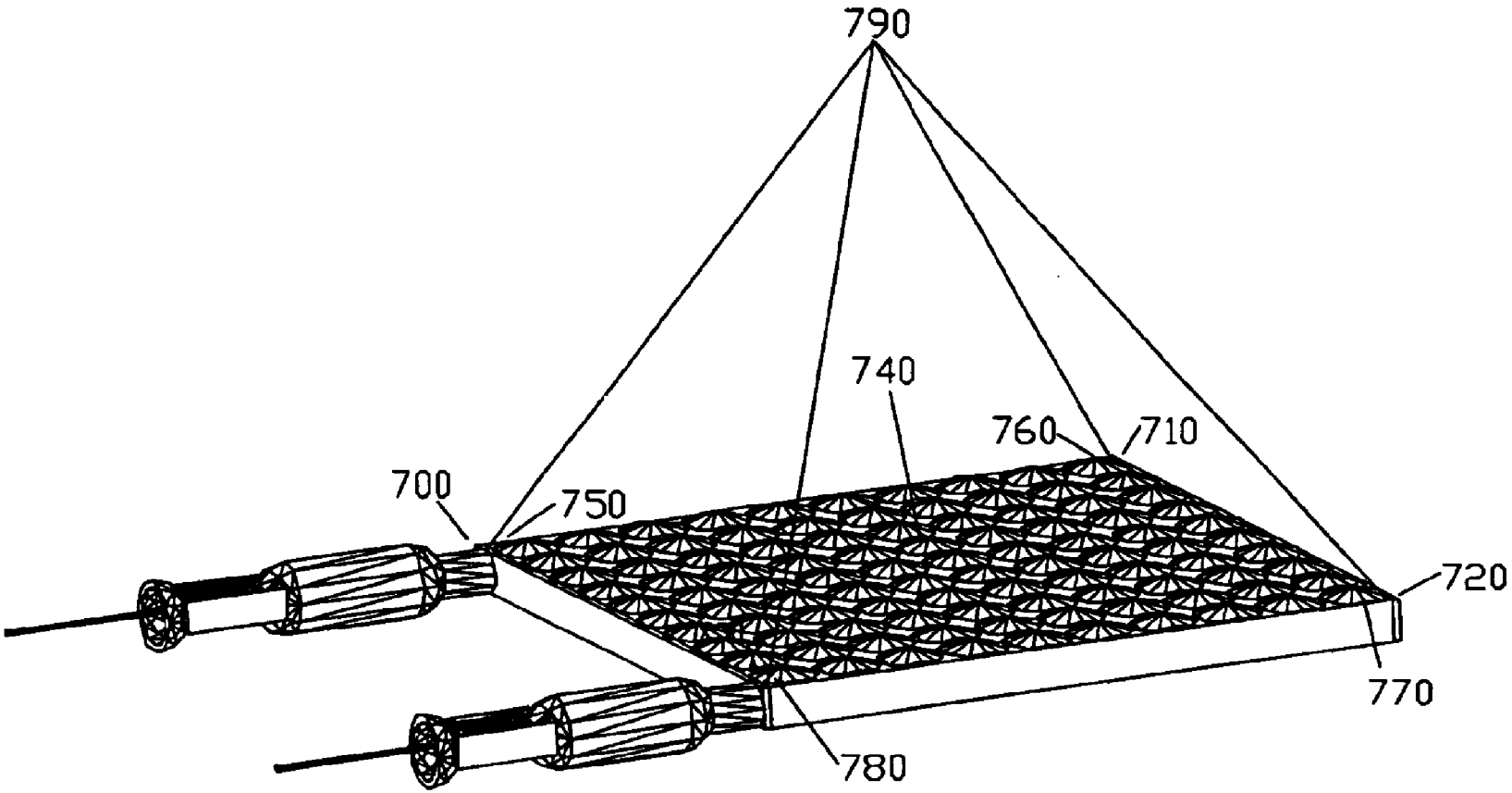
FIG. 7 is a lamp with a lamp body which utilizes a lens array in accordance with one embodiment of the present invention.

FIG. 7 is a lamp with a lamp body which utilizes a lens array in accordance with one embodiment of the present invention. FIG. 7 may be embodied using any of the lamp body configurations described herein, where the lamp body has an arc path formed therein. At comers 700, 710, 720, and 730 of lamp body 740 are placed sealed lenses designated as 750, 760, 770, and 780. In one embodiment, the lenses are cylindrical micro lenses. Lenses 750–780 are designed to collimate the output or focus all of the light in the lamp to a single point 790. Prior art serpentine lamps cannot focus all of the light to a single point because it would require attachment of the lenses to the serpentine glass tube. Such an attachment provides for insufficient areas of attachment in which to stabilize the lenses.

Thus, an electric discharge lamp with a lamp body having a plurality of vanes is described in conjunction with one or more specific embodiments. The invention is defined by the claims and their full scope of equivalents.

What is claimed is:

1. A lamp body comprising:

a block of glass with a front end, a back end, and left end, and a right end;

a plurality of parallel channels formed in said glass and extending from said front end of said block of glass and exiting said back end, said parallel channels having a septum of glass separating each of said channels to form an arc path; and a front end plate coupled to said front end and a back end plate coupled to said back end.

2. The lamp body of claim 1 wherein a portion of every other septum of said front end is removed to form a link between pairs of channels at said front end.

3. The lamp body of claim 2 wherein a portion of every other septum of said back end is removed to form a link between alternate pairs of channels at said back end.

4. The lamp body of claim 3 wherein said front end plate is sealed into said lamp body at said front end and said back end plate is sealed into said lamp body at said back end.

5. The lamp body of claim 4 further including a pair of electrodes coupled to said lamp body.

6. The lamp body of claim 5 wherein said glass comprises quartz.

* * * * *

UNITED STATES PATENT AND TRADEMARK OFFICE

CERTIFICATE OF CORRECTION

PATENT NO. : 6,731,058 B1
DATED : May 4, 2004
INVENTOR(S) : Kincade, Randal S.

It is certified that error appears in the above-identified patent and that said Letters Patent is hereby corrected as shown below:

Delete Figs. 5A, 5B, 5C, 5D.

Signed and Sealed this

Twentieth Day of July, 2004

JON W. DUDAS
*Acting Director of the United States Patent and Trademark Office*